US008019256B2

(12) United States Patent
Lange

(10) Patent No.: US 8,019,256 B2
(45) Date of Patent: Sep. 13, 2011

(54) MULTI-MODE LONG LIFE MONOCHROME PRINTING SYSTEM

(75) Inventor: Clark V Lange, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 567 days.

(21) Appl. No.: 12/176,594

(22) Filed: Jul. 21, 2008

(65) Prior Publication Data

US 2010/0014893 A1 Jan. 21, 2010

(51) Int. Cl.
*G03G 15/01* (2006.01)

(52) U.S. Cl. ..... 399/228; 399/223

(58) Field of Classification Search ..... 399/223, 399/222, 225, 228, 54
See application file for complete search history.

(56) References Cited

U.S. PATENT DOCUMENTS 5,080,988 A * 1/1992 Germain et al. ..... 430/54
5,754,932 A * 5/1998 Tahara ..... 399/303
5,911,527 A 6/1999 Aruga et al.
6,148,159 A * 11/2000 Shiraishi ..... 399/44
6,352,806 B1 * 3/2002 Dalal ..... 430/45.4
6,421,133 B2 7/2002 Kasai et al.
6,678,493 B2 * 1/2004 Maeyama et al. ..... 399/302
7,274,883 B2 9/2007 Evans
7,278,699 B2 10/2007 Drake et al.
2003/0129002 A1 * 7/2003 Yoo ..... 399/228
2006/0133843 A1 * 6/2006 Sugaya ..... 399/82
2008/0159786 A1 * 7/2008 Tombs et al. ..... 399/222
2008/0240788 A1 * 10/2008 Mashtare et al. ..... 399/223

* cited by examiner

*Primary Examiner* — David Gray
*Assistant Examiner* — Rodney Bonnette
(74) *Attorney, Agent, or Firm* — Fay Sharpe LLP

(57) ABSTRACT

A multi-mode, long life monochrome printing system that includes (a) a media supply assembly having a media path (b) a moveable intermediate transfer member for receiving images from image output terminal assemblies and for transferring the images to media on the media path; and (c) a plural number of monochrome image output terminal (IOT) assemblies adjacent the moveable intermediate transfer member, each monochrome image output terminal (IOT) assembly being selectably moveable into and out of image transfer relationship with the moveable intermediate transfer member, and each monochrome image output terminal (IOT) assembly having a development unit including developer material having essentially a same color.

21 Claims, 5 Drawing Sheets

MULTI-MODE LONG LIFE MONOCHROME PRINTING SYSTEM

The present disclosure relates to electrostatographic image producing machines and, more particularly to an electrostatographic multi-mode long life monochrome printing system.

BACKGROUND OF DISCLOSURE

Generally, electrostatographic copying, image production or reproduction is performed in cycles for example by exposing an image of an original document onto a substantially uniformly charged photoreceptive member. The photoreceptive member has a photoconductive layer. Ordinarily, exposing the charged photoreceptive member with the image discharges areas of the photoconductive layer corresponding to non-image areas of the original document, while maintaining the charge in the image areas. In discharge area development, the reverse is true where the image areas are the discharged areas and the non-image areas are the charged areas. Thus in either case, a latent electrostatic image of the original document is created on the photoconductive layer of the photoreceptive member.

Charged developing material is subsequently deposited on the photoreceptive member to develop the latent electrostatic image areas. The developing material may be a liquid material or a powder material. The charged developing material is attracted to the charged image areas on the photoconductive layer. This attraction develops the latent electrostatic image into a visible toner image. The visible toner image is then transferred from the photoreceptive member, either directly or after an intermediate transfer step, to a copy sheet or other support substrate as an unfused toner image which is then heated and permanently affixed to the copy sheet, resulting in a reproduction or copy of the original document. In a final step, the photoconductive surface of the photoreceptive member is cleaned to remove any residual developing material in order to prepare it for successive imaging cycles.

Following is a discussion of prior art, incorporated herein by reference, which may bear on the patentability of the present disclosure. In addition to possibly having some relevance to the question of patentability, these references, together with the detailed description to follow, are intended to provide a better understanding and appreciation of the present disclosure.

U.S. Pat. No. 7,278,699 issued Oct. 9, 2007 to Drake et al. and entitled "Enhanced printer reliability using extra print module" discloses methods and apparatus for extending the reliability and usefulness of a fullwidth printhead by providing a redundant temporary replacement printhead module that can be positioned to compensate for missing or faulty jet nozzles. In order to take advantage of a single extra printhead module and to be able to compensate for more than a single failed nozzle, the replacement module is mounted on a separate translating x-axis and preferably provided with roll adjustment along another axis so that an effective spacing of nozzles in the replacement module can be adjusted to align with detected defective nozzles. The fullwidth printhead is formed from at least one array of smaller printhead modules. The arrays may be offset by a non-integer spacing interval of the individual nozzles. For example, if the nozzle spacing is S, the offset may be S/2. By virtue of the x-translation and roll capabilities, a single replacement module can accommodate replacement of one or several defective nozzles spaced closer together than the total length L of the replacement module, even if the defective nozzle(s) are located on different printhead modules and have a non-integer spacing.

U.S. Pat. No. 7,274,883 issued Sep. 25, 2007 to Evans and entitled "Hybrid printer and related system and method" discloses a hybrid printing assembly that includes a first printing subassembly operable to produce a first pattern on a medium, and a second printing subassembly operable to produce a second pattern on the medium.

U.S. Pat. No. 6,421,133 issued Jul. 16, 2002 to Kasai et al. and entitled "Hybrid printer, printer mounting base and printer that is mountable on printer mounting base" discloses a hybrid printer includes a first printer, a second printer and a printer mounting base capable of mounting the first and second printers. The first printer has a first printing section for printing on a first recording paper, a first transfer path for transferring the first recording paper to the first printing section, a first base having the first transfer path formed thereon, and a first cantilever for supporting the first printing section above the first base. The second printer has a second printing section for printing on a second recording paper. The printer mounting base has a second base, a second transfer path formed on the second base and a second cantilever fixed to the second base. The second printer is mountable on the second cantilever of the printer mounting base. The printer mounting base is mountable in the rear of the first printer, and the second transfer path is disposed on an extension line of the first transfer path and continuous to the first transfer path when the printer mounting base is mounted on the first printer.

U.S. Pat. No. 5,911,527 issued Jun. 15, 1999 to Aruga et al. and entitled "Hybrid printer device equipped with a plurality of printing mechanisms and control method therefore" discloses a hybrid printer has mounted thereon a plurality of printing mechanisms and error processing appropriate to the respective printing mechanisms with differing functions and appropriate to the printing paper can be performed. Thermal printer state detector 65 and wire dot printer state detector 66 are provided which have the capability of detecting the respective states of thermal printing mechanism 10 and wire dot printing mechanism 20 mounted on hybrid printer 1. Further, printing mechanism selector 71 is capable of determining the printing mechanism selected from command data indicating the type paper. This makes it possible for state determination member 72 to know the error status of each printing mechanism and to determined which printing mechanism is in operation, and therefore it is possible to quickly perform error processing appropriate to the printing mechanism.

Conventionally, it is well known to provide printing systems that include one or more modules (xerographic modules) that perform electrostatographic copying, image production or reproduction as described above. As is also well known, such xerographic modules include limited components and use limited life materials, and so their operation has to be stopped or interrupted from time to time in order to replace such components or replenish such materials.

There therefore has been a need for printing systems that offer increasingly more and more uninterrupted long life along with other benefits.

SUMMARY OF DISCLOSURE

In accordance with the present disclosure, there is provided a multi-mode, long life monochrome printing system that includes (a) a media supply assembly having a media path (b) a moveable intermediate transfer member for receiving images from image output terminal assemblies and for transferring the images to media on the media path; and (c) a plural number of monochrome image output terminal (IOT) assemblies adjacent the moveable intermediate transfer member, each monochrome image output terminal (IOT) assembly being selectably moveable into and out of image transfer relationship with the moveable intermediate transfer member, and each monochrome image output terminal (IOT) assembly having a development unit including developer material having essentially a same color.

DETAILED DESCRIPTION

Referring now to FIGS. 1-5 the architecture and different operating modes of the multi-mode long life monochrome printing system 100 of the present disclosure are illustrated. As shown, the multi-mode long life monochrome printing system 100 of the present disclosure has 3 monochrome image output modules M1, M2, M3, two of which (M1, M2) have/contain standard black toner K1, K2, and the other (M3) has a "light" black or gray toner KL. Each module M1, M2, M3 is fully capable of being operated alone to produce images using its particular toner K1, K2, KL. Additionally, when one of the standard black toner modules, for example M1 with K1, and the gray toner module M3 are used in combination, the two different shades of black toners K1 and KL can be used effectively to produce images with improved gray scale smoothness as well as with enhanced highlights and mid-tones. The results as such would be comparable to what one gets from commonly used techniques in high quality offset printing and in ink jet systems usually accepted and used for printing high quality photographs.

In accordance with an aspect of the present disclosure, as M1 is being operated to make standard black toner images alone, or gray scale images in combination with the gray toner module M3 as described above, the other standard black toner module M2 would be held in reserve (as a redundant or standby module).

Figure 1:
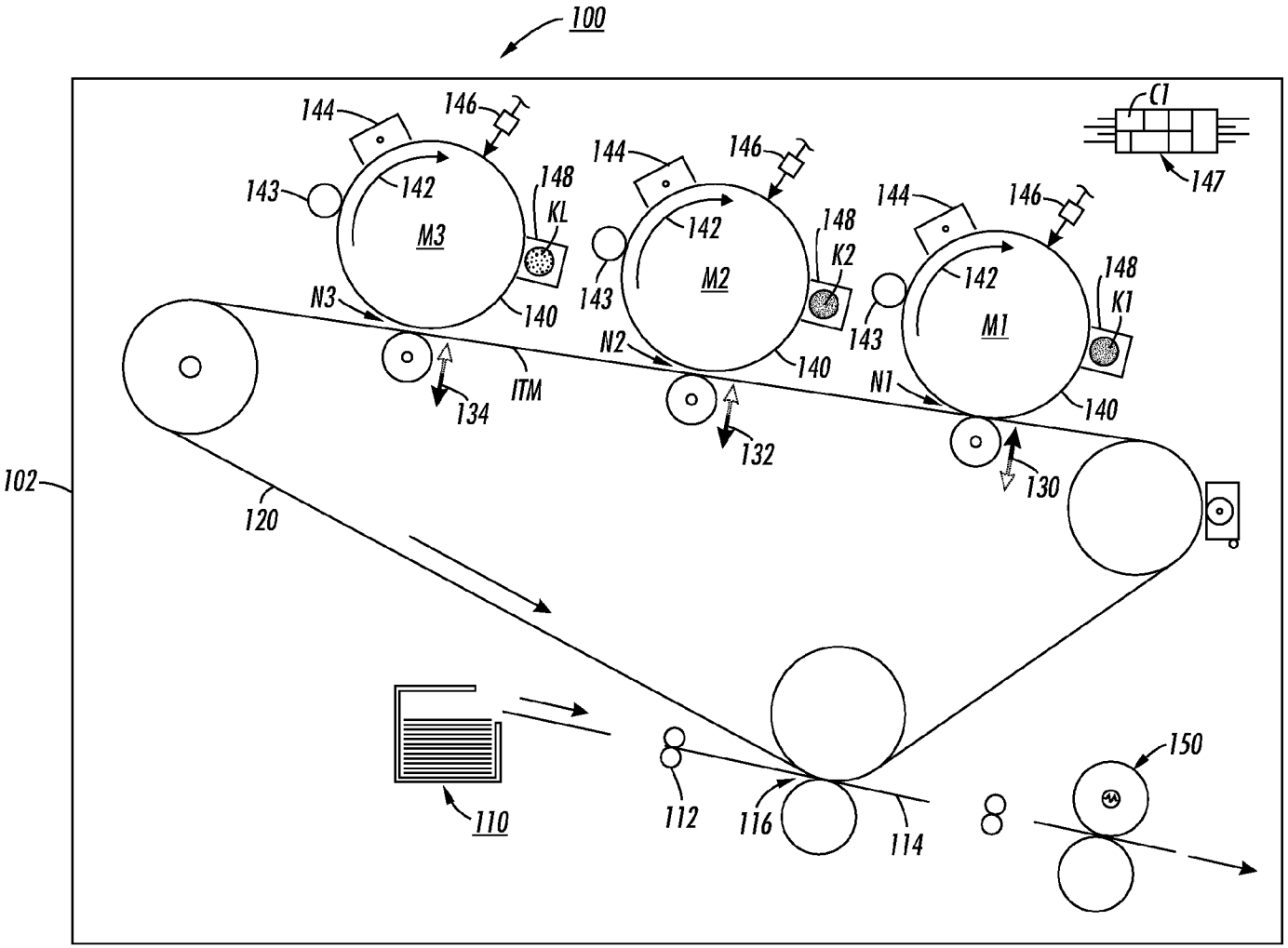
FIG. 1 is a schematic elevational view of the multi-mode long life monochrome printing system of the present disclosure showing a first mode for producing only standard black toner images using M1 (K1) with the second standard black module M2 (K2) and the gray module M3 (KL) being held in reserve.
Figure 2:
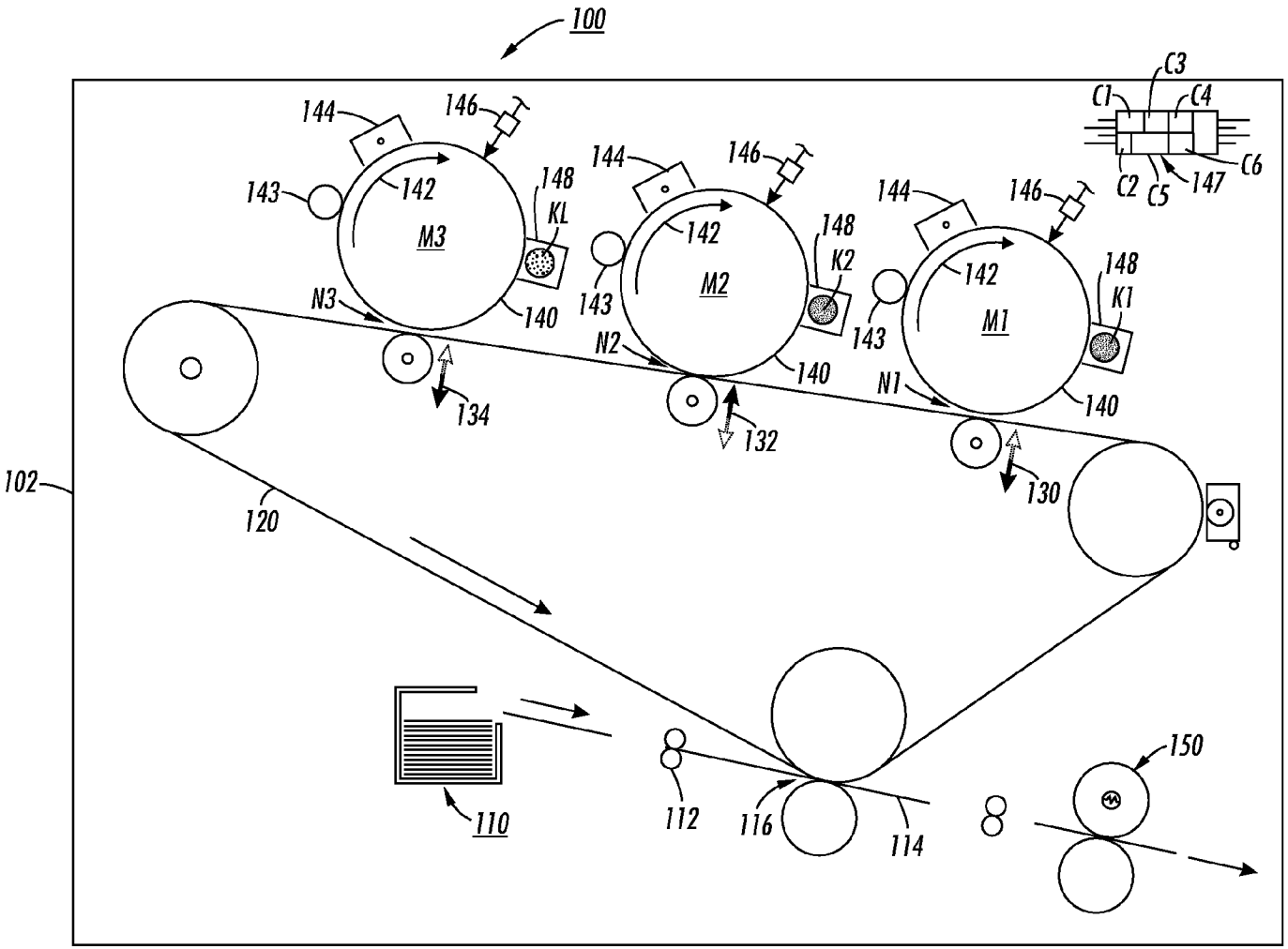
FIG. 2 is a schematic elevational view of the multi-mode long life monochrome printing system of the present disclosure showing a second mode for also producing only standard black toner images using M2 (K2) with the first standard black module M1 (K1) and the gray module M3 (KL) being held in reserve.
Figure 3:
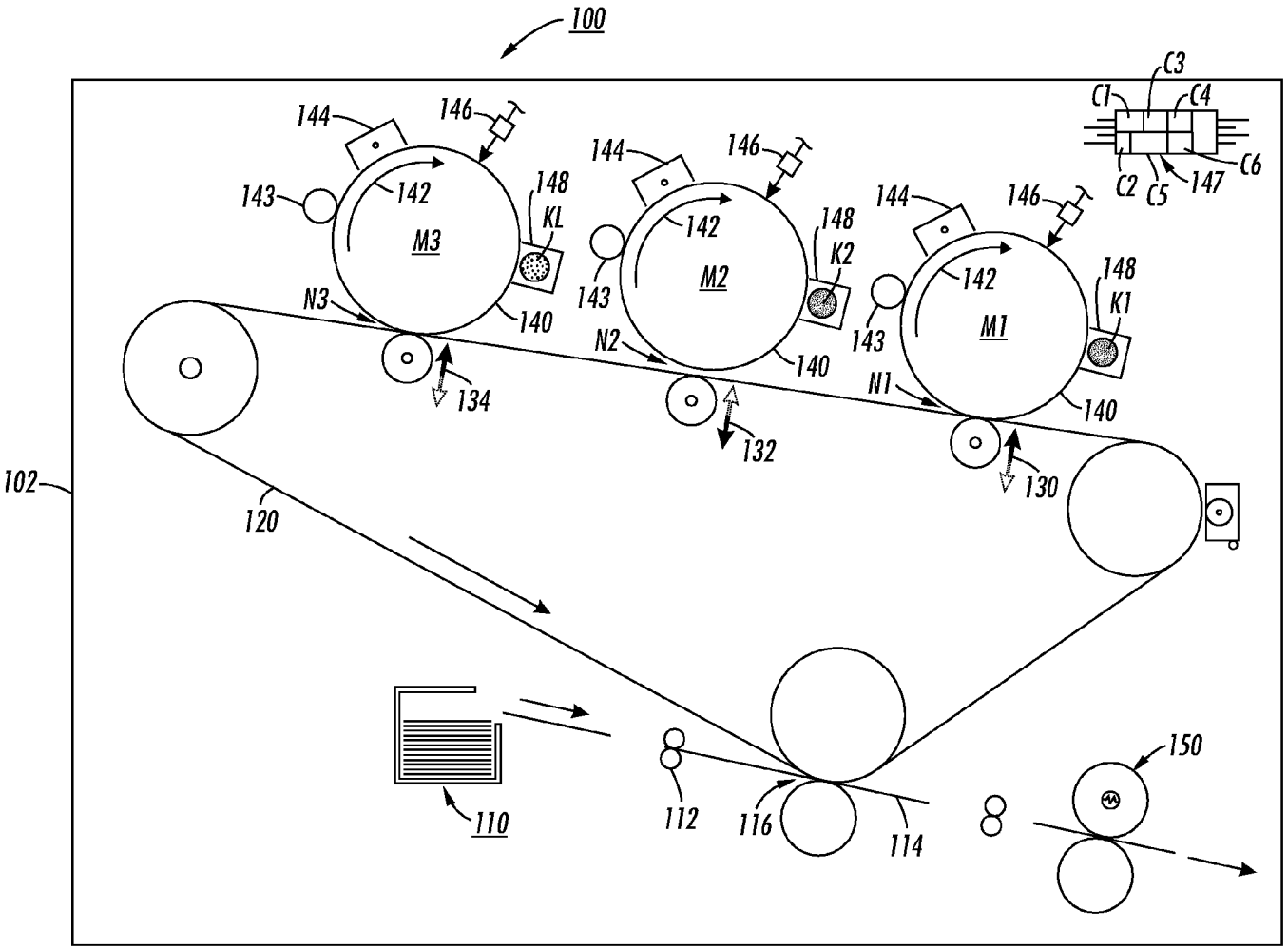
FIG. 3 is a schematic elevational view of the multi-mode long life monochrome printing system of the present disclosure showing a third mode for producing standard black and mid-tone toner images using M1 (K1) and the gray module M3 (KL) with the second standard black module M2 (K2) being held in reserve.
Figure 4:
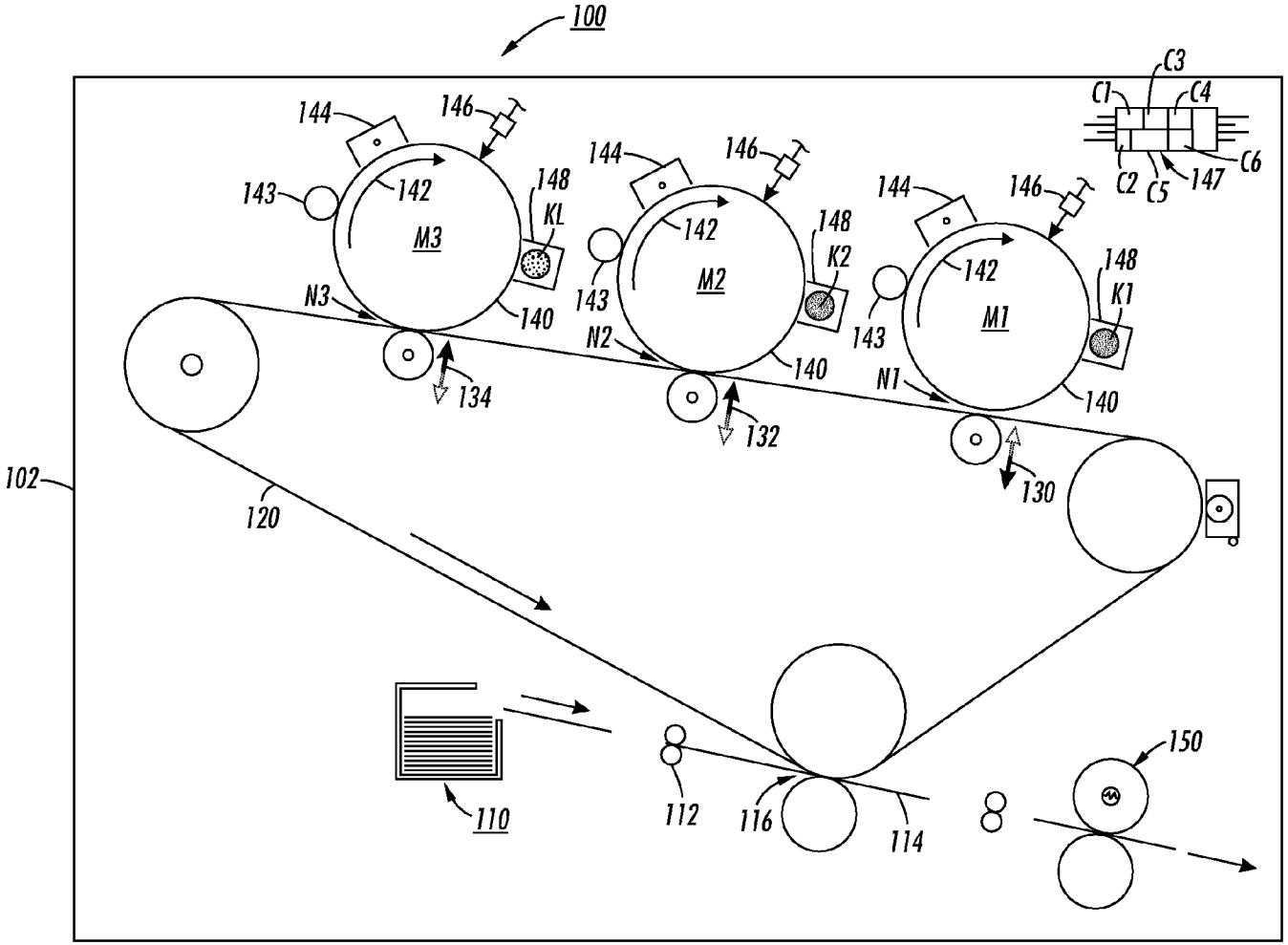
FIG. 4 is a schematic elevational view of the multi-mode long life monochrome printing system of the present disclosure showing a fourth mode for producing standard black and mid-tone toner images using M2 (K2) and the gray module M3 (KL) with the first standard black module M1 (K1) being held in reserve.
Figure 5:
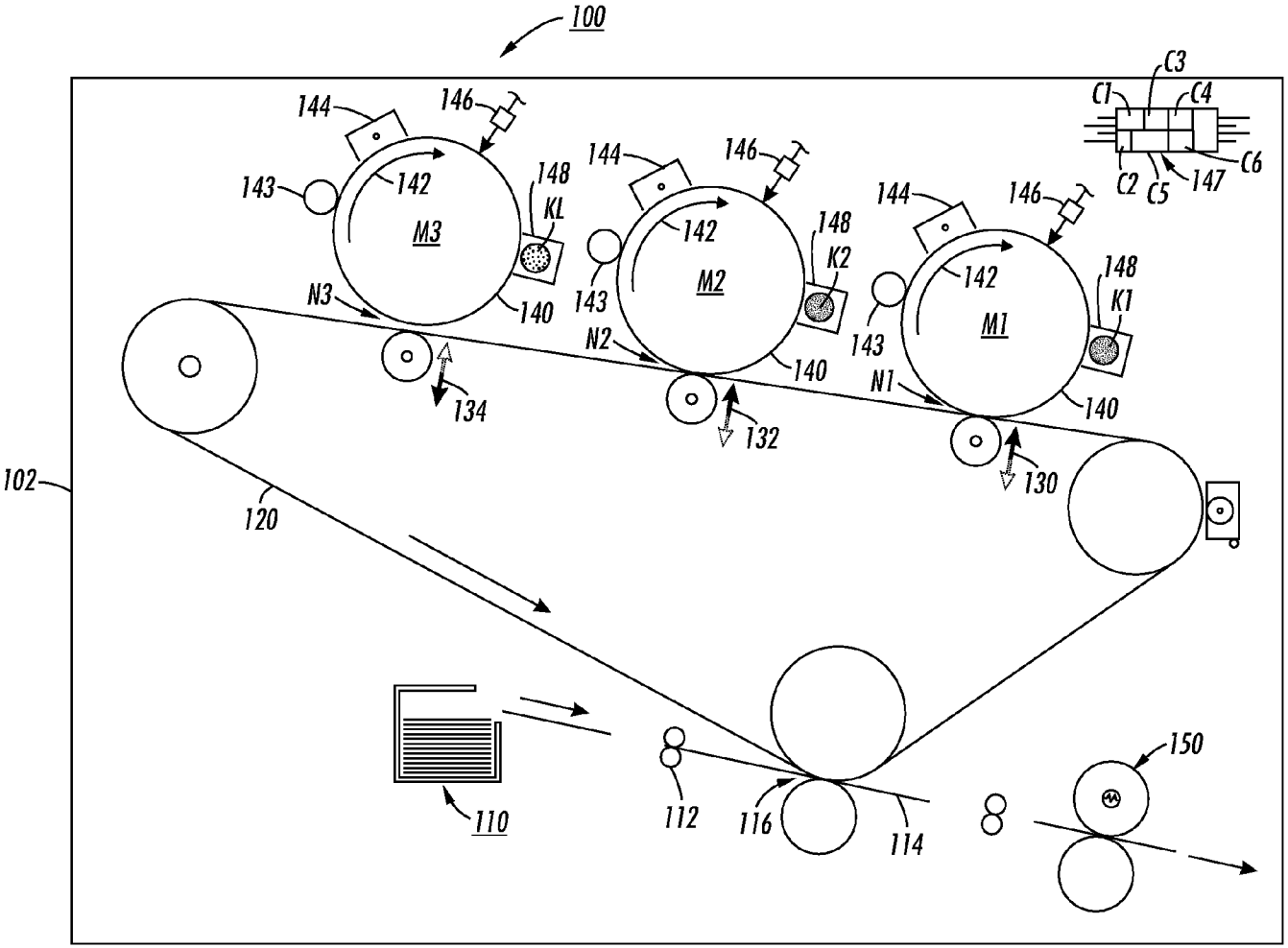
FIG. 5 is a schematic elevational view of the multi-mode long life monochrome printing system of the present disclosure showing a fifth mode for producing standard black toner images using the two standard black toner modules M1 (K1), and M2 (K2) for a lighter duty-load operation on each module, with the gray module M3 (KL) being held in reserve.

As a further aspect of the present disclosure shown in FIG. 5, both standard black toner modules M1, M2 could also be operated at the same time for producing standard black toner images for example each producing 50% of the prints, thereby resulting in a lower duty cycle per module. For customers with high monthly printing volume needs, the redundant printing system and low duty cycle printing capabilities will be welcome benefits.

More specifically as shown, the multi-mode long life monochrome printing system 100 includes (a) a machine frame 102; (b) a media supply assembly 110 including a media path 112 mounted within the machine frame; (c) a moveable intermediate transfer member 120 mounted within the machine frame for receiving images from image output terminal assemblies and for transferring the images to media using a pre-fuser transfer belt 114 on the media path; and (d) a plural number (3) of monochrome image output terminal (IOT) assemblies or modules M1, M2, M3, mounted with the image frame, each of the plural number of monochrome image output terminal (IOT) assemblies (i) being mounted adjacent the moveable intermediate transfer member 120, (ii) having a development unit including developer material having essentially a same color, and (iii) the moveable intermediate transfer member 120 being selectably moveable at indicated points by means 130, 132, 134 into and out of image transfer relationship with the image bearing member of each module M1, M2, M3.

As illustrated, each monochrome image output terminal (IOT) assembly or module M1, M2, M3 is xerographic and includes a moveable image bearing member or photoreceptor 140 moving in the direction. A cleaning device 143 cleans the surface of the image bearing member, a charging device 144 uniformly charges the surface, an exposure device 146 under the control of a controller 147 image-wise exposes the charged surface to form electrostatic images, and a development apparatus 148 containing appropriate toner K1, K2, KL develops or makes the electrostatic images visible.

The media path 112 includes an image transfer station or nip 116 where the moveable intermediate transfer member 120 is in contact with the media path. The moveable intermediate transfer member 120 comprises an endless belt as shown. The plural number of monochrome image output terminal (IOT) assemblies or modules comprises at least a first monochrome image output terminal (IOT) assembly or module M1 and a second monochrome image output terminal (IOT) assembly or module M2. The development unit 148 of the second monochrome image output terminal (IOT) assembly or module M2 includes developer material having exactly the same color (standard black) K2 as developer material, standard black K1 in the development unit 148 of the first monochrome image output terminal (IOT) assembly or module M1.

In accordance with the present disclosure, the development unit of the third monochrome image output terminal (IOT) assembly or module M3 includes developer material KL that has a color comprising essentially a lighter or less saturated version of the color of developer material (standard black K1, K2) in the development units of the first and second monochrome image output terminal (IOT) assemblies or modules M1, M2. Specifically, the developer material K1, K2 having essentially a same color comprises standard black toner, and the developer material KL is gray toner.

Although the disclosure has been described with the developer material having essentially a monochrome same color being standard black and being a lighter black (gray), it can be easily understood that such monochrome color of such developer material could be for example (a) standard yellow and a lighter or less saturated yellow; (b) standard blue and a lighter or less saturated blue; (c) standard red and a lighter or less saturated red; or (d) standard green and a lighter or less saturated green.

As further illustrated, the multi-mode long life monochrome printing system 100 includes a controller 147 having connections to each of the plural number of image output terminal (IOT) assemblies or modules M1, M2, M3 for controlling operation of the multi-mode long life printing system.

The controller 147 includes a first mode C1 (FIG. 1) in which only the first monochrome image output terminal (IOT) assembly or module M1 is selected, that is, its xerographic process is activated to make standard black images using standard black toner K1, and the image transfer nip N1 is engaged for transferring the black images to the intermediate transfer member 120. As described earlier, in this mode, the second and third modules M2 and M3 will not be selected and instead will be held in reserve with the nips N2 and N3 open and unengaged.

The controller 147 also includes a second mode C2 (FIG. 2) in which only the second monochrome image output terminal (IOT) assembly or module M2 is selected, that is, its xerographic process is activated to make standard black images using its standard black toner K2, and the image transfer nip N2 is engaged for transferring the black images to the intermediate transfer member 120. As described earlier, in this mode, the first and third modules M1 and M3 will not be selected and instead will be held in reserve with the nips N1 and N3 open and unengaged.

The controller 147 further includes a third mode C3 (FIG. 3) in which the first monochrome image output terminal (IOT) assembly or module M1 (with standard black toner K1), and the third monochrome image output terminal (IOT) assembly or module M3 with gray toner KL, are both selected and operated as above to produce smooth gray scale and mid-tone black images that are then transferred (with the nips N1 and N3 engaged) onto the intermediate transfer member 120. As described earlier, in this mode, the second module M2 will not be selected and instead will be held in reserve with the nip N2 open and unengaged.

The controller 147 similarly includes a fourth mode C4 (FIG. 4) in which the second monochrome image output terminal (IOT) assembly or module M2 (with standard black toner K2), and the third monochrome image output terminal (IOT) assembly or module M3 with gray toner KL, are both selected and operated as above to produce smooth gray scale and mid-tone black images that are then transferred (with the nips N1 and N3 engaged) onto the intermediate transfer member 120. As described earlier, in this mode, the first module M1 will not be selected and instead will be held in reserve with the nip N2 open and unengaged.

The controller 147 as shown includes a sixth mode C6 (FIG. 5) in which the first monochrome image output terminal (IOT) assembly or module M1 and the second monochrome image output terminal (IOT) assembly or module M2 (each with standard black toner) are both selected and programmed to operate simultaneously to produce standard black toner images. As pointed out above, each for example may be programmed to produce only 50% of the prints in the job, and that significantly reduces or lowers the duty cycle load per monochrome image output terminal (IOT) assembly as such. In this mode, the third module will not be selected and instead will be held in reserve with the nip N3 open and unengaged.

The multi-mode long life xerographic monochrome printing system 100 includes a fusing apparatus 150 mounted within the machine frame 102 downstream of the media path 112 for receiving and fusing media carrying toner images.

To recap, the multi-mode long life monochrome printing system 100 of the present disclosure has 3 monochrome image output modules M1, M2, M3, two of which (M1, M2) have standard black toners K1, K2, and the other (M3) has a "light" black or gray toner KL. Each module M1, M2, M3 is fully capable of being operated alone to produce images using its particular toner K1, K2, KL. Additionally, when one of the standard black toner module, for example M1, and the gray toner module M3 are used in combination, the two different shades of black toners K1, KL would produce images with improved gray scale smoothness as well as with enhanced highlights and mid-tones. This will be comparable to results from a commonly used technique in high quality offset printing and in ink jet systems usually accepted and used for printing high quality photographs.

Meanwhile, as M1 is being operated to make standard black toner images alone, or gray scale images in combination with the gray toner module M3 as described above, the other standard black toner module M2 would be held in reserve (as a redundant or standby module).

As can be seen, there has been provided a multi-mode, long life monochrome printing system that includes (a) a media supply assembly having a media path (b) a moveable intermediate transfer member for receiving images from image output terminal assemblies and for transferring the images to media on the media path; and (c) a plural number of monochrome image output terminal (IOT) assemblies adjacent the moveable intermediate transfer member, each monochrome image output terminal (IOT) assembly being selectably moveable into and out of image transfer relationship with the moveable intermediate transfer member, and each monochrome image output terminal (IOT) assembly having a development unit including developer material having essentially a same color.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A multi-mode long life monochrome printing system comprising:

(a) a machine frame;

(b) a media supply assembly including a media path mounted within said machine frame; and (c) a plural number of monochrome image output terminal (IOT) assemblies mounted with said image frame, each of said plural number of monochrome image output terminal (IOT) assemblies (i) being mounted adjacent a moveable intermediate transfer member and (ii) having a development unit including developer material having essentially a same color;

wherein said moveable intermediate transfer member mounted within said machine frame for receiving images from said image output terminal assemblies and for transferring said images to associated media on said media path, said moveable intermediate transfer member being selectably moveable into and out of image transfer relationship with said image output terminal assemblies.

2. The multi-mode long life monochrome printing system of claim 1, wherein said media path includes an image transfer station where said moveable intermediate transfer member is in contact with said media path.

3. The multi-mode long life monochrome printing system of claim 1, wherein said media path includes a pre-fuser media transport belt.

4. The multi-mode long life monochrome printing system of claim 1, wherein said moveable intermediate transfer member comprises an endless belt.

5. The multi-mode long life monochrome printing system of claim 1, wherein said plural number of monochrome image output terminal (IOT) assemblies comprises at least a first monochrome image output terminal (IOT) assembly and a second monochrome image output terminal (IOT) assembly.

6. The multi-mode long life monochrome printing system of claim 5, wherein the development unit of said second monochrome image output terminal (IOT) assembly includes developer material having exactly the same color as developer material in the development unit of said first monochrome image output terminal (IOT) assembly.

7. The multi-mode long life monochrome printing system of claim 5, wherein the development unit of said second monochrome image output terminal (IOT) assembly includes developer material having a color consisting of a lighter-hue of the color of developer material in the development unit of said first monochrome image output terminal (IOT) assembly.

8. The multi-mode long life monochrome printing system of claim 1, wherein developer material having essentially a same color comprises developer material having a standard black and a lighter black developer materials.

9. The multi-mode long life monochrome printing system of claim 1, wherein said plural number of monochrome image output terminal (IOT) assemblies comprises a first monochrome image output terminal (IOT) assembly including a standard black developer material, a second monochrome image output terminal (IOT) assembly also including a standard black developer material, and a third monochrome image output terminal (IOT) assembly including a lighter-hue black developer material.

10. The multi-mode long life monochrome printing system of claim 1, including a controller having connections to each of said plural number of image output terminal (IOT) assemblies for controlling operation of said multi-mode long life printing system.

11. The multi-mode long life monochrome printing system of claim 10, wherein said developer material having said essentially a same color comprises standard black developer material and a lighter-hue black developer material (ii) said plural number of monochrome image output terminal (IOT) assemblies comprises a first monochrome image output terminal (IOT) assembly including said standard black developer material, a second monochrome image output terminal (IOT) assembly also including said standard black developer material, and a third monochrome image output terminal (IOT) assembly including said lighter-hue black developer material.

12. The multi-mode long life monochrome printing system of claim 11, wherein said controller includes a first-mode wherein only said first monochrome image output terminal (IOT) assembly is selected and operated to produce standard black images.

13. The multi-mode long life monochrome printing system of claim 11, wherein said controller includes a mode wherein only said second monochrome image output terminal (IOT) assembly is selected and operated to produce standard black images.

14. The multi-mode long life monochrome printing system of claim 11, wherein said controller includes a mode wherein said first monochrome image output terminal (IOT) assembly and said third monochrome image output terminal (IOT) assembly are both selected and operated to produce smooth gray scale and mid-tone black images.

15. The multi-mode long life monochrome printing system of claim 11, wherein said controller includes a mode wherein said second monochrome image output terminal (IOT) assembly and said third monochrome image output terminal (IOT) assembly are both selected and operated to produce smooth gray scale and mid-tone black images.

16. The multi-mode long life monochrome printing system of claim 11, wherein said controller includes a mode wherein said first monochrome image output terminal (IOT) assembly and said second monochrome image output terminal (IOT) assembly are both selected and programmed to operate simultaneously for significantly reducing the lower duty cycle per monochrome image output terminal (IOT) assembly in producing standard black images.

17. The multi-mode long life monochrome printing system of claim 11, wherein said controller includes a mode wherein said first monochrome image output terminal (IOT) assembly and said second monochrome image output terminal (IOT) assembly are both selected and programmed to sequentially operate to produce standard black images one after the life of the other.

18. The multi-mode long life monochrome printing system of claim 1, wherein developer material having essentially a same color comprises developer material having one of a standard yellow, green and red developer material and one of a lighter yellow, green and red developer materials.

19. A multi-mode long life monochrome xerographic printing system comprising:

(a) a machine frame;

(b) a media supply assembly including a media path mounted within said machine frame;

(c) a moveable intermediate transfer member mounted within said machine frame for receiving toner images from image output terminal assemblies and for transferring said toner images to associated media on said media path; and (d) a plural number of monochrome toner image output terminal (IOT) assemblies mounted with said image frame, each of said plural number of monochrome toner image output terminal (IOT) assemblies (i) being mounted adjacent said moveable intermediate transfer member and (ii) having a development unit including toner having essentially a same color;

wherein said moveable intermediate transfer member is adapted to move into and out of image transfer relationship with a select one of said plural number of monochrome toner image output terminal assemblies based on a determined mode of operation.

20. The multi-mode long life xerographic monochrome printing system of claim 19, wherein said developing units of at least two of said monochrome toner image output terminal assemblies include different shades of black toner.

21. A multi-mode long life monochrome printing system comprising:

a machine frame;

a media supply assembly including a media path mounted within said machine frame;

a first monochrome image output terminal (IOT) assembly mounted within said image frame adjacent a moveable intermediate transfer member and including a standard black developer material;

a second monochrome image output terminal (IOT) assembly mounted within said image frame adjacent said moveable intermediate transfer member and including a lighter-hue black developer material; and, said moveable intermediate transfer member adapted to receive an image from a select one or combination of said first and second monochrome image output terminal assemblies for transferring said image to associated media on said media path.

* * * * *